United States Patent [19]

Miyasaka et al.

[11] Patent Number: 5,049,210

[45] Date of Patent: Sep. 17, 1991

[54] OIL COUNTRY TUBULAR GOODS OF A LINE PIPE FORMED OF A HIGH-STRENGTH MARTENSITIC STAINLESS STEEL

[75] Inventors: Akihiro Miyasaka; Hiroyuki Ogawa, both of Sagamihara, Japan

[73] Assignee: Nippon Steel Corporation, Japan

[21] Appl. No.: 480,599

[22] Filed: Feb. 15, 1990

[30] Foreign Application Priority Data

Feb. 18, 1989 [JP] Japan ..... 1-38956
Mar. 20, 1989 [JP] Japan ..... 1-68715

[51] Int. Cl.[5] ..... C22C 38/20

[52] U.S. Cl. ..... 428/586; 148/909; 148/136; 420/90; 420/103; 420/104

[58] Field of Search ..... 148/325, 909; 420/60, 420/61

[56] References Cited

U.S. PATENT DOCUMENTS 4,326,885 4/1982 Larson et al. ..... 420/60
4,769,213 9/1988 Haswell, Jr. et al. ..... 420/60

FOREIGN PATENT DOCUMENTS 257780 3/1988 European Pat. Off. .
60-174859 9/1985 Japan .
62-054063 8/1987 Japan .
2145734 4/1985 United Kingdom ..... 420/61
2179675 3/1987 United Kingdom .

*Primary Examiner*—Deborah Yee
*Attorney, Agent, or Firm*—Pollock, Vande Sande & Priddy

[57] ABSTRACT

A high-strength martensitic stainless steel excellent in corrosion resistance and stress corrosion cracking resistance, the composition of which comprises: 0.1% or less carbon, 1% or less silicon, 2% or less manganese, 8–14% chromium, 1.2–4.5% copper, 0.005–0.2% aluminum, 0.01–0.15% nitrogen, and the balance of iron except incidental elements. The stainless steel can contain nickel, molybdenum, tungsten, vanadium, titanium, niobium, etc. under the fixed conditions in addition to the above elements. The heat treatment of the stainless steel comprises: the step of austenitizing at temperatures of 920° C. to 1,000° C., the step of cooling at a cooling rate equal to or higher than the air cooling rate, the step of tempering at temperatures between 580° C. and $A_{cl}$ point, and the step of cooling at a cooling rate higher than the air cooling rate.

14 Claims, No Drawings

OIL COUNTRY TUBULAR GOODS OF A LINE PIPE FORMED OF A HIGH-STRENGTH MARTENSITIC STAINLESS STEEL

BACKGROUND OF THE INVENTION

This invention relates to a martensitic stainless steel that is excellent in corrosion resistance and stress corrosion cracking resistance and to a method of heat treatment of the steel. More particularly it relates to a high-strength steel that has high corrosion resistance and cracking resistance in an environments containing wet carbon dioxide and wet hydrogen sulfide, for example, in well drilling for and transportation and storage of petroleum and natural gas, and to a method of heat treatment of the steel.

Petroleum and natural gas produced recently contain much wet carbon dioxide in increasingly many cases. It is well known that carbon steels and low-alloy steels corrode greatly in those environments with carbon dioxide. For this reason, corrosion inhibitors have so far been added to prevent the corrosion of OCTG (Oil Country Tubular Goods; e.g. casings and tubings) used for production and of line pipes used for transportation. However, corrosion inhibitors often lose their effects at high temperature and besides the cost required for the addition and recovery of corrosion inhibitors is immense in off-shore oil wells and submarine pipelines; therefore, corrosion inhibitors cannot be used in many cases. For this reason, the need of corrosion-resistant materials that do not require the addition of corrosion inhibitors has recently become very great.

The application of stainless steels with good corrosion resistance was first examined as corrosion-resistant materials for petroleum and natural gas containing much carbon dioxide. For example, as in L. J. Klein, Corrosion/'84, Paper No. 211, martensitic stainless steels containing 12 to 13% chromium, such as AISI type 410 and 420 steels, begin to be used widely as steels that have high strength and are produced at relatively low costs. These steels, however, have the disadvantage that they do not show satisfactory corrosion resistance and exhibit large corrosion rates at high temperatures of more than 130° C., for example, or at high concentrations of $Cl^-$ ions even in an environment with wet carbon dioxide. These steels have another disadvantage that when petroleum and natural gas contain hydrogen sulfide, their corrosion resistance deteriorates greatly, thus causing general corrosion and localized corrosion, and further even stress corrosion cracking (in this case, sulfide stress cracking, hereinafter referred to as SSC). Therefore, the use of the above martensitic stainless steels has so far been limited to a case where the environment contains an ultratrace amount of $H_2S$ gas, for example, the partial pressure of $H_2S$ gas is not more than 0.001 atm or the environment does not contain $H_2S$ gas in the least.

The steels described in Japanese Patent Unexamined Publications 60-174859 and 62-54063, for example, have been proposed as martensitic stainless steels in which the resistance to the cracking by hydrogen sulfide is improved. However, the cracking by hydrogen sulfide is not completely prevented in these steels. In addition, these steels have the disadvantage that the cost is high because nickel, which is an expensive alloying element, is used in large quantities.

SUMMARY OF THE INVENTION

Accordingly, the principal object of the present invention is to provide an inexpensive martensitic stainless steel that has satisfactory corrosion resistance even in an environment containing carbon dioxide at elevated temperatures and high concentrations of $Cl^-$ ions and provide high SSC resistance even when the environment contains hydrogen sulfide.

The inventors of the present invention have examined compositions of martensitic stainless steels in various ways in order to achieve the above object and have finally obtained the following knowledge.

The present inventors first found out that the corrosion rate in an environment with wet carbon dioxide decreases greatly when copper is added to steels containing 8–14% chromium. They also found out that the effect of copper addition is remarkable when the amount of added copper is 1.2% or more. Furthermore, it was clarified that when the carbon content is reduced to 0.1% (preferably 0.02%) or less at copper contents of 1.2% or more, the corrosion resistance in an environment with wet carbon dioxide is improved further, with the result that the steels can be used at elevated temperatures exceeding 200° C. Since copper is an element that is very inexpensive compared with nickel, the rate of increase in the material cost is small even if copper is added in amounts of 1.2% of more. Also, it was found that strength can be increased further if 0.01% or more nitrogen is added to steels which contain 1.2% or more copper and whose carbon contents are reduced to under 0.1% (preferably 0.02%) or less. The present inventors obtained the further knowledge that the steels of these composition have high SSC resistance even in an environment containing hydrogen sulfide.

The present inventors continued the examination further and revealed that the corrosion resistance in an environment containing $H_2S$ gas is improved further by reducing the phosphorus content to 0.025% or less and the sulfur content to 0.015% or less in steels to which 1.2% or more copper is added, whose carbon contents are reduced to 0.1% (preferably 0.02%) or less, and to which 0.01% or more nitrogen is added. Also, they found that the corrosion rate in an environment with wet carbon dioxide at elevated temperature or high concentrations of $Cl^-$ ions can be reduced further by adding nickel and manganese to these steels.

This invention was made based on the above-mentioned knowledge.

According to one freature of the present invention, there are provided high-strength martensitic stainless steels which contain: 0.1% or less carbon, 1% or less silicon, 2% or less manganese, 8–14% chromium, 1.2–4.5% copper, 0.005–0.2% aluminum, 0.01–0.15% nitrogen, and the balance of iron except incidental elements. The stainless steels of the above compositions according to the invention can contain at least one element selected from the group comprising 4% or less nickel, 2% or less molybdenum and 4% or less tungsten, and/or at least one element selected from the group comprising 0.5% or less vanadium, 0.2% or less titanium and 0.5% or less niobium, 0.2% or less zirconium, 0.2% or less tantalum, and 0.2% or less hafnium. Further, the stainless steels of the present invention can contain 0.008% or less calcium and/or 0.02% or less rare earth elements.

According to another feature of the present invention, there is provided a method of heat treatment which involves austenitizing the stainless steel of the above compositions at temperature of 920° C. to 1,100° C. followed by cooling at a cooling rate equal to or higher than the air cooling rate, and then tempering at temperatures between 580° C. and $A_{c1}$ point followed by cooling at a cooling rate equal to or higher than the air cooling rate. This heat treatment enables the stainless steel of the present invention to fully display their excellent properties, i.e., excellent corrosion resistance, excellent stress corrosion cracking resistance and high strength property.

The reasons for the addition of alloying elements included in the stainless steel of the present invention and the reasons for the limitations of the contents of the elements will be described in the following. The heat treatment conditions for the stainless steel will also be described.

Carbon: Carbon is an element that can increase the strength of martensitic stainless steels in the most stable manner and is inexpensive. However, the presence of a large amount of carbon in steel decreases the corrosion resistance in an environment with wet carbon dioxide and lowers the SSC resistance in an environment where hydrogen sulfide is present. Therefore, it is necessary that the carbon content be 0.1% maximum and the effect of carbon addition on the improvement of corrosion resistance is great at carbon contents of 0.02% or less.

Silicon: This element is necessary for deoxidation. However, because corrosion resistance is lowered greatly when over 1% silicon is added, the maximum silicon content should be 1%.

Manganese: This element is effective in deoxidation and in obtaining strength. However, the manganese content should be 2% maximum because the effect of manganese addition remains unchanged even when 2% is exceeded.

Chromium: Chromium is the most basic and necessary element that composes martensitic stainless steels and is necessary for imparting corrosion resistance to them. However, corrosion resistance is not satisfactory at chromium contents of under 8%. On the other hand, if chromium is added in amounts exceeding 14%, it is difficult for the single phase of austenite to be formed when the steels are heated to high temperatures, no matter how other alloying elements are adjusted; this makes it difficult to obtain strength. Therefore, the maximum chromium content should be 14%.

Copper: This element remarkably lowers the corrosion rate of martensitic stainless steels in an environment of wet carbon dioxide and is very effective in lowering the SSC sensitivity greatly in an environment containing hydrogen sulfide by adjusting the carbon and nitrogen contents However, these effects are unsatisfactory when the copper content is under 1.2%, while copper contents exceeding 4.5% not only cause these effects to remain unchanged, but also remarkably lower hot workability. Therefore, the copper content is limited to the range of 1.2 to 4.5%.

Aluminum: Aluminum is an element necessary for deoxidation. This effect is not satisfactory at aluminum contents of under 0.005%, while coarse oxide-based inclusions remain in steel at aluminum contents exceeding 0.2%. Therefore, the aluminum content should range from 0.005 to 0.2%.

Nitrogen: Nitrogen is effective in increasing the strength of martensitic stainless steels. However, this effect is not satisfactory when the nitrogen content is under 0.01%. When the nitrogen content exceeds 0.15%, however, nitrogen lowers corrosion resistance by generating nitrides of chromium and also lowers cracking resistance, therefore, the nitrogen content should range from 0.01 to 0.15%.

The above elements compose the basic compositions of the steel of the present invention. In this invention, the properties of the steel can be improved further by adding the following elements as required.

Phosphorus: Because phosphorus intensifies SSC sensitivity, the smaller the amount of this element, the better. However, lowering the phosphorus content to too low a level not only results in an increase in cost, but also causes the effect on the improvement of the properties to remain unchanged. Therefore, stress corrosion cracking resistance is improved further when the phosphorus content is lowered to levels low enough to obtain the corrosion resistance and stress corrosion cracking resistance aimed at in this invention, i.e., 0.025% or less.

Sulfur: Like phosphorus, sulfur intensifies SSC sensitivity. For this reason, the smaller the amount of sulfur, the better. However, lowering the sulfur content to too low a level not only results in an increase in cost, but also causes the effect on the improvement on the properties to remain unchanged. Therefore, stress corrosion cracking resistance is improved further when the phosphorus content is lowered to levels low enough to obtain the corrosion resistance and stress corrosion cracking resistance aimed at in this invention, i.e., 0.015% or less.

Nickel: In the co-presence of 1.2% or more copper, nickel is effective in improving the corrosion resistance in an environment with wet carbon dioxide. However, addition of over 4% nickel not only causes this effect to remain unchanged, but also lowers the SSC resistance in an environment containing hydrogen sulfide. Therefore, the maximum nickel content should be 4%.

Molybdenum: In the co-presence of 1.2% or more copper, molybdenum is effective in improving the corrosion resistance in an environment with wet carbon dioxide. However, addition of over 2% molybdenum not only causes this effect to remain unchanged, but also deteriorates other properties such as toughness. Therefore, the maximum molybdenum content should be 2%.

Tungsten: In the co-presence of 1.2% or more, tungsten is also effective in improving the corrosion resistance in an environment with wet carbon dioxide. However, addition of over 4% tungsten not only causes this effect to remain unchanged, but also deteriorates other properties such as toughness. Therefore, the maximum tungsten content should be 4%.

Vanadium, titanium, niobium, tantalum, zirconium and hafnium: These elements are effective in further improving corrosion resistance. However, when titanium, zirconium, tantalum and hafnium are added in amounts exceeding 0.2% and vanadium and niobium are added in amounts exceeding 0.5%, these elements generate coarse precipitates and inclusions, which lower the SSC resistance in an environment containing hydrogen sulfide. Therefore, the maximum content should be 0.2% for titanium, zirconium, tantalum and hafnium and 0.5% for vanadium and niobium.

Calcium and rare earth elements: Calcium and rare earth elements are effective in improving hot workability and corrosion resistance. However, when calcium is added in amounts exceeding 0.008% and rare earth elements are added in amounts exceeding 0.02%, these elements generate coarse nonmetallic inclusions, which deteriorate hot workability and corrosion resistance. Therefore, the maximum content should be 0.008% for calcium and 0.02% for rare earth elements. The rare earth elements are defined, herein, as elements of which atomic numbers are in the range of 57-71 and 99-103.

The reason why the austenitizing temperature range of 920° C. to 1,100° C. was selected to impart the desired strength to the stainless steel of the present invention by obtaining the structure of martensite through heat treatment, is that austenitizing does not occur thoroughly at temperatures under 920° C., thus making it difficult to obtain the required strength, while grains coarsen remarkably at austenitizing temperatures exceeding 1,100° C., lowering the SSC resistance in an environment containing hydrogen sulfide. Therefore, the austenitizing temperature should range from 920° C. to 1,100° C.

The reason why the cooling rate in the cooling after austenitizing should be equal to or higher than the air cooling rate, is that martensite is not formed sufficiently at cooling rates lower than the air cooling rate, thus making it difficult to obtain the desired strength.

The reason why the tempering temperature should range from 580° C. to $A_{c1}$ point, is that tempering does not occur thoroughly at tempering temperatures of under 580° C., while austenitizing occurs partially at tempering temperatures exceeding $A_{c1}$ point, resulting in the generation of fresh martensite during the cooling after tempering. In both cases, martensite that is not thoroughly tempered remains, increasing the SSC sensitivity in an environment containing hydrogen sulfide.

The reason why the cooling rate in the cooling after tempering should be equal to or higher than the air cooling rate, is that toughness decreases at cooling rates lower than the air cooling rate.

The steel of the present invention can be used as plates produced by ordinary hot rolling and can also be used as pipes produced by hot extrusion or hot rolling; it can naturally be used as rods and wires. The steels of the present invention can be used in many applications, such as valve and pump parts, in addition to OCTG and line pipe.

EXAMPLE 1

Stainless steels of the compositions given in Table 1 were cast after melting and were hot rolled to 12 mm thick plates, which were heat treated under the conditions also shown in Table 1 to produce high-strength steels with 0.2% offset yield strength of 56 kg/mm$^2$ or more. Test pieces were then taken from these steel plates and were subjected to the corrosion test in an environment of wet carbon dioxide and the SSC test in an environment containing hydrogen sulfide. Test pieces 3 mm in thickness, 15 mm in width and 50 mm in length were used in the corrosion test in an environment with wet carbon dioxide. The test pieces were immersed in a 10% NaCl aqueous solution for 30 days in an autoclave at test temperatures of 150° C. and 200° C. and a partial pressure of carbon dioxide of 40 atm, and the corrosion rate was calculated from changes in weight before and after the test. In this specification, the corrosion rate is expresed in mm/year. When the corrosion rate of a material in a certain environment is 0.1 mm/year or less, it is generally considered that this material sufficiently resists corrosion and can be used. The SSC test in an environment containing hydrogen sulfide was conducted according to the standard test method of the National Association of Corrosion Engineers (NACE) specified in the NACE Standard TM0177. A constant uniaxial tensile stress was applied to test pieces set in a 5% NACl+0.5% acetic acid aqueous solution saturated with hydrogen sulfide at 1 atm to investigate whether the test pieces rupture within 720 hours. The test stress was 60% of the 0.2% offset yield strength of each steel.

The results of the two tests are shown in Table 1. Concerning the results of the corrosion test shown in Table 1, the symbol ◎ designates corrosion rates of under 0.05 mm/y, the symbol ○ corrosion rates of 0.05 mm/y to under 0.10 mm/y, the symbol X corrosion rates of 0.1 mm/y to under 0.5 mm/y, and the symbol XX corrosion rates of 0.5 mm/y or more. Concerning the results of the SSC test, the symbol ◎ represents test pieces that did not rupture and the symbol X represents test pieces that ruptured. Incidentally, the steel of Comparative Example No. 29 in Table 1 is the AISI 420 steel and the steel of No. 30 is an 9Cr-1Mo steel; both are known steels that have so far been used in an environment with wet carbon dioxide.

Evaluation of Test Results

As is apparent from Table 1, the steels No. 1 to No. 28 that are the steels of the present invention show corrosion rates lower than 0.1 mm/y, at which steels can be used in practical applications, even in an environment with wet carbon dioxide at a very high temperature of 200° C., which is inconceivable for conventional martensitic stainless steels, and at a very high Cl− ion concentration of 10% NaCl and do not rupture in the SSC test conducted in an environment containing hydrogen sulfide. This demonstrates that these steels have excellent corrosion resistance and stress corrosion cracking resistance. In contrast to these steels, the steels No. 29 to No. 34 that are the comparative steels show corrosion rates by far higher than 0.1 mm/y in an environment with wet carbon dioxide even at 150° C. and rupture in the SSC test conducted in an environment containing hydrogen sulfide.

TABLE 1

| | | Composition (%) | | | | | | | | | | | | |
|---|---|---|---|---|---|---|---|---|---|---|---|---|---|---|
| | No. | C | Si | Mn | Cr | Cu | Al | N | P | S | Ni | Mo | W | Others |
| Alloy | 1 | 0.012 | 0.53 | 1.40 | 11.88 | 3.49 | 0.028 | 0.074 | N.A. | N.A. | — | — | — | |
| of | 2 | 0.004 | 0.19 | 0.45 | 12.75 | 4.82 | 0.016 | 0.048 | N.A. | N.A. | — | — | — | |
| The | 3 | 0.003 | 0.10 | 0.53 | 12.84 | 2.84 | 0.023 | 0.063 | N.A. | N.A. | — | — | — | |
| Present | 4 | 0.012 | 0.19 | 1.47 | 13.21 | 3.84 | 0.022 | 0.063 | N.A. | N.A. | — | — | — | |
| Invention | 5 | 0.006 | 0.29 | 0.54 | 11.97 | 1.89 | 0.031 | 0.059 | 0.006 | N.A. | — | — | — | |
| | 6 | 0.002 | 0.51 | 0.76 | 12.89 | 2.69 | 0.009 | 0.034 | 0.017 | 0.005 | — | — | — | |
| | 7 | 0.008 | 0.30 | 0.49 | 12.76 | 1.98 | 0.024 | 0.073 | 0.015 | 0.004 | 2.55 | — | — | |
| | 8 | 0.004 | 0.43 | 0.26 | 13.11 | 3.02 | 0.020 | 0.053 | N.A. | 0.004 | — | 1.01 | — | |
| | 9 | 0.003 | 0.17 | 0.52 | 12.67 | 3.34 | 0.028 | 0.034 | N.A. | N.A. | 1.56 | 0.83 | 0.62 | |
| | 10 | 0.004 | 0.36 | 0.37 | 12.66 | 2.56 | 0.010 | 0.042 | 0.017 | 0.001 | — | — | — | Ti 0.047 |
| | 11 | 0.010 | 0.20 | 0.48 | 13.02 | 2.07 | 0.017 | 0.063 | N.A. | N.A. | — | — | — | Zr 0.054 |

TABLE 1-continued

| | | | | | | | | | | | | | | |
|---|---|---|---|---|---|---|---|---|---|---|---|---|---|---|
| | 12 | 0.011 | 0.49 | 1.53 | 9.14 | 3.74 | 0.029 | 0.082 | 0.016 | 0.005 | — | — | — | Nb 0.083 |
| | 13 | 0.005 | 0.28 | 0.56 | 12.87 | 2.74 | 0.034 | 0.073 | N.A. | N.A. | — | — | — | V 0.063 |
| | 14 | 0.005 | 0.35 | 0.68 | 11.56 | 2.66 | 0.027 | 0.060 | 0.020 | 0.004 | — | — | — | |
| | 15 | 0.004 | 0.05 | 0.46 | 12.49 | 3.57 | 0.028 | 0.069 | N.A. | N.A. | — | — | — | Ti 0.062, Nb 0.055 |
| | 16 | 0.004 | 0.32 | 0.42 | 13.03 | 2.78 | 0.029 | 0.053 | 0.014 | 0.005 | — | — | — | Ti 0.038, V 0.044 |
| | 17 | 0.004 | 0.24 | 0.34 | 12.67 | 2.90 | 0.030 | 0.048 | 0.016 | 0.004 | — | — | — | Ca 0.005 |
| | 18 | 0.005 | 0.25 | 0.53 | 11.45 | 3.36 | 0.029 | 0.065 | N.A. | N.A. | — | — | — | REM 0.007 |
| | 19 | 0.006 | 0.29 | 0.39 | 12.59 | 3.01 | 0.018 | 0.054 | 0.015 | 0.005 | — | — | — | Ca 0.004 |
| | 20 | 0.013 | 0.30 | 0.44 | 13.16 | 2.63 | 0.021 | 0.073 | 0.013 | 0.002 | 1.37 | — | — | |
| | 21 | 0.006 | 0.20 | 1.62 | 12.04 | 3.04 | 0.026 | 0.074 | 0.014 | 0.001 | 1.54 | 1.13 | — | |
| | 22 | 0.005 | 0.25 | 0.73 | 11.83 | 3.24 | 0.012 | 0.048 | 0.012 | 0.003 | — | — | — | Ti 0.046, Zr 0.012, Nb 0.033 |
| | 23 | 0.006 | 0.46 | 0.39 | 12.93 | 1.88 | 0.029 | 0.064 | 0.011 | 0.003 | 3.48 | — | — | Ti 0.049, Nb 0.038, V 0.031 |
| | 24 | 0.005 | 0.06 | 0.63 | 11.99 | 3.00 | 0.020 | 0.083 | 0.004 | 0.001 | 2.45 | 1.27 | — | Nb 0.079, Ta 0.015 |
| | 25 | 0.007 | 0.26 | 0.48 | 13.31 | 3.62 | 0.031 | 0.073 | 0.010 | 0.002 | — | — | 0.58 | Ti 0.036, Hf 0.011, Ca 0.003 |
| | 26 | 0.003 | 0.33 | 0.35 | 12.58 | 2.74 | 0.022 | 0.049 | 0.012 | 0.004 | 2.66 | 1.11 | 1.75 | Zr 0.035, Nb 0.052, REM 0.008 |
| | 27 | 0.003 | 0.18 | 0.41 | 12.26 | 3.16 | 0.041 | 0.082 | 0.010 | N.A. | — | 1.27 | 0.31 | Ti 0.055, Ta 0.037, Ca 0.006 |
| | 28 | 0.002 | 0.27 | 0.94 | 12.68 | 3.04 | 0.018 | 0.058 | 0.011 | 0.003 | 0.54 | — | — | Nb 0.030, Hf 0.020 |
| Comparative Alloy | 29 | 0.210 | 0.45 | 0.51 | 13.02 | — | 0.031 | 0.004 | 0.027 | 0.008 | 0.35 | — | — | |
| | 30 | 0.122 | 0.28 | 0.58 | 9.12 | — | 0.027 | 0.003 | 0.029 | 0.006 | — | 1.05 | — | |
| | 31 | 0.037 | 0.40 | 0.53 | 12.95 | — | 0.034 | 0.055 | 0.018 | 0.008 | 0.44 | — | — | |
| | 32 | 0.078 | 0.23 | 0.38 | 11.84 | 0.75 | 0.028 | 0.022 | 0.023 | 0.006 | 0.18 | 0.33 | — | |
| | 33 | 0.196 | 0.37 | 0.43 | 12.94 | 0.49 | 0.055 | 0.008 | 0.020 | 0.007 | 0.19 | — | — | Ca 0.007 |
| | 34 | 0.086 | 0.77 | 0.44 | 13.11 | — | 0.023 | 0.003 | 0.019 | 0.003 | — | — | 0.30 | |

| | | Heat temperature | | Results of corrosion test*1 | | |
|---|---|---|---|---|---|---|
| | | Austenitizing temperature and cooling | Tempering temperature and cooling | Test temperature 150° C. | Test temperature 200° C. | Results of SSC test |
| Alloy of The Present Invention | 1 | 1000° C., air cooling | 660° C., air cooling | ◎ | ○ | ◎ |
| | 2 | 1000° C., air cooling | 700° C., air cooling | ◎ | ◎ | ◎ |
| | 3 | 1010° C., air cooling | 680° C., air cooling | ◎ | ◎ | ◎ |
| | 4 | 1000° C., air cooling | 700° C., air cooling | ◎ | ◎ | ◎ |
| | 5 | 1000° C., oil cooling | 640° C., air cooling | ◎ | ◎ | ◎ |
| | 6 | 1030° C., air cooling | 600° C., air cooling | ◎ | ◎ | ◎ |
| | 7 | 1000° C., air cooling | 720° C., oil cooling | ◎ | ○ | ◎ |
| | 8 | 1000° C., air cooling | 700° C., air cooling | ◎ | ◎ | ◎ |
| | 9 | 1010° C., water cooling | 680° C., air cooling | ◎ | ◎ | ◎ |
| | 10 | 1010° C., air cooling | 680° C., air cooling | ◎ | ◎ | ◎ |
| | 11 | 1020° C., air cooling | 650° C., air cooling | ◎ | ◎ | ◎ |
| | 12 | 980° C., air cooling | 750° C., air cooling | ◎ | ○ | ◎ |
| | 13 | 1000° C., air cooling | 700° C., air cooling | ◎ | ○ | ◎ |
| | 14 | 1000° C., air cooling | 710° C., air cooling | ◎ | ◎ | ◎ |
| | 15 | 1000° C., air cooling | 700° C., air cooling | ◎ | ◎ | ◎ |
| | 16 | 1010° C., air cooling | 740° C., air cooling | ◎ | ○ | ◎ |
| | 17 | 1010° C., air cooling | 720° C., air cooling | ◎ | ◎ | ◎ |
| | 18 | 1010° C., air cooling | 720° C., air cooling | ◎ | ◎ | ◎ |
| | 19 | 1000° C., air cooling | 700° C., air cooling | ◎ | ◎ | ◎ |
| | 20 | 1030° C., air cooling | 680° C., air cooling | ◎ | ◎ | ◎ |
| | 21 | 1020° C., air cooling | 660° C., air cooling | ◎ | ◎ | ◎ |
| | 22 | 990° C., oil cooling | 660° C., air cooling | ◎ | ◎ | ◎ |
| | 23 | 990° C., oil cooling | 650° C., air cooling | ◎ | ◎ | ◎ |
| | 24 | 1000° C., air cooling | 700° C., air cooling | ◎ | ◎ | ◎ |
| | 25 | 1000° C., air cooling | 720° C., air cooling | ◎ | ◎ | ◎ |

TABLE 1-continued

| | | | | | | |
|---|---|---|---|---|---|---|
| | 26 | 1000° C., air cooling | 700° C., air cooling | ◎ | ◎ | ◎ |
| | 27 | 1010° C., water cooling | 700° C., air cooling | ◎ | ◎ | ◎ |
| | 28 | 1020° C., air cooling | 700° C., air cooling | ◎ | ◎ | ◎ |
| Comparative Alloy | 29 | 1020° C., air cooling | 730° C., air cooling | × | ×× | × |
| | 30 | 980° C., air cooling | 700° C., air cooling | ×× | ×× | × |
| | 31 | 1030° C., air cooling | 700° C., air cooling | × | ×× | × |
| | 32 | 1030° C., oil cooling | 700° C., air cooling | × | ×× | × |
| | 33 | 1030° C., air cooling | 700° C., air cooling | ×× | ×× | × |
| | 34 | 1030° C., air cooling | 700° C., air cooling | ×× | ×× | × |

*[1]Corrosion test conditions: 10% NaCl aqueous solution, partial pressure of $CO_2$ 40 atm. 720 hours.
N.A.; not analyzed

EXAMPLE 2

Stainless steels of the compositions given in Table 2 were cast after melting and were hot rolled to 12 mm thick plates, which were heat treated under the conditions also shown in Table 2 to produce high-strength steels with 0.2% offset yield strength of 63 kg/mm$^2$ or more. Test pieces were then taken from these steel plates and were subjected to the corrosion test in an environment of wet carbon dioxide and the SSC test in an environment contining hydrogen sulfide. Test pieces 3 mm in thickness, 15 mm in width and 50 mm in length were used in the corrosion test in an environment with wet carbon dioxide. The test pieces were immersed in a 3% NaCl aqueous solution for 30 days in an autoclave at test temperatures of 150° C. and 180° C. and a partial pressure of carbon dioxide of 40 atm, and the corrosion rate was calculated from changes in weight before and after the test. In this specification, the corrosion rate is expressed in mm/year. When the corrosion rate of a material in a certain environment is 0.1 mm/year lr less, it is generally considered that this material thoroughly resists corrosion and can be used. The SSC test in an environment containing hydrogen sulfide was conducted according to the standard test method of the National Association of Corrosion Engineers (NACE) specified in the NACE Standard TM0177. A constant uniaxial tensile stress was applied to test pieces set in a 5% NACl+0.5% acetic acid aqueous solution saturated with hydrogen sulfide at 1 atm to investigate whether the test pieces rupture within 720 hours. The test stress was 60% of the 0.2% offset yield strength of each steel.

The results of the two tests are shown in Table 2. Concerning the results of the corrosion test shown in Table 2, the symbol ◎ designates corrosion rates of under 0.05 mm/y, the symbol ○ corrosion rates of 0.05 mm/y to under 0.10 mm/y, the symbol X corrosion rates of 0.1 mm/y to under 0.5 mm/y, and the symbol XX corrosion rates of 0.5 mm/y or more. Concerning the results of the SSC test, the symbol ◎ represents test pieces that did not rupture and the symbol x represents test pieces that ruptured. Incidentally, the steel of Comparative Example No. 69 in Table 2 is the AISI 420 steel and the steel of No. 70 is an 9Cr-1Mo steel; both are known steels so far been used in an environment of wet carbon dioxide.

Evaluation of Test Results

As is apparent from Table 2, the steels No. 41 to No. 68 that are the steels of the present invention show corrosion rates lower than 0.1 mm/y, at which steels can be used in practical applications, even in an environment with wet carbon dioxide at a very high temperature of 180° C., which is inconceivable for conventional martensitic stainless steels, and at a very high Cl$^-$ ion concentration of 10% NaCl and do not rupture in the SSC test conducted in an environment containing hydrogen sulfide. This demonstrates that these steels have excellent corrosion resistance and stress corrosion cracking resistance. In contrast to these steels, the steels No. 69 to No. 74 that are the comparative steels show corrosion rates by far higher than 0.1 mm/y in an environment of wet carbon dioxide even at 150° C. and rupture in the SSC test conducted in an environment containing hydrogen sulfide.

TABLE 2

| | | Composition (%) | | | | | | | | | | | | |
|---|---|---|---|---|---|---|---|---|---|---|---|---|---|---|
| | No. | C | Si | Mn | Cr | Cu | Al | N | P | S | Ni | Mo | W | Others |
| Alloy of The Present Invention | 41 | 0.092 | 0.56 | 0.48 | 12.23 | 2.62 | 0.031 | 0.026 | N.A. | N.A. | — | — | — | |
| | 42 | 0.024 | 0.09 | 0.82 | 13.25 | 4.28 | 0.025 | 0.018 | N.A. | N.A. | — | — | — | |
| | 43 | 0.033 | 0.14 | 1.54 | 11.96 | 3.55 | 0.030 | 0.032 | N.A. | N.A. | — | — | — | |
| | 44 | 0.026 | 0.18 | 0.42 | 12.53 | 2.99 | 0.019 | 0.068 | N.A. | N.A. | — | — | — | |
| | 45 | 0.040 | 0.39 | 0.62 | 12.95 | 1.38 | 0.030 | 0.024 | 0.015 | N.A. | — | — | — | |
| | 46 | 0.075 | 0.41 | 0.93 | 11.84 | 3.68 | 0.016 | 0.024 | 0.006 | 0.004 | — | — | — | |
| | 47 | 0.052 | 0.20 | 0.32 | 13.05 | 2.03 | 0.032 | 0.042 | N.A. | N.A. | 3.59 | — | — | |
| | 48 | 0.022 | 0.53 | 0.91 | 10.33 | 4.49 | 0.043 | 0.057 | N.A. | N.A. | — | 1.58 | — | |
| | 49 | 0.046 | 0.10 | 0.45 | 9.02 | 3.98 | 0.029 | 0.037 | N.A. | N.A. | 1.26 | 1.03 | — | |
| | 50 | 0.026 | 0.28 | 1.36 | 12.87 | 2.54 | 0.012 | 0.066 | 0.012 | 0.003 | 1.58 | — | 2.95 | |
| | 51 | 0.059 | 0.27 | 0.72 | 12.50 | 1.61 | 0.052 | 0.017 | N.A. | N.A. | — | — | — | Ti 0.082 |
| | 52 | 0.038 | 0.26 | 0.59 | 11.86 | 2.94 | 0.035 | 0.037 | 0.011 | 0.001 | — | — | — | Zr 0.033 |
| | 53 | 0.054 | 0.33 | 0.45 | 12.13 | 2.55 | 0.007 | 0.053 | N.A. | N.A. | — | — | — | Nb 0.18 |
| | 54 | 0.078 | 0.37 | 1.24 | 12.21 | 3.88 | 0.023 | 0.015 | N.A. | N.A. | — | — | — | V 0.075 |
| | 55 | 0.043 | 0.12 | 0.79 | 11.98 | 3.42 | 0.025 | 0.038 | 0.013 | 0.003 | — | — | — | Ti 0.038, Nb 0.065, |

TABLE 2-continued

| | | | | | | | | | | | | | | |
|---|---|---|---|---|---|---|---|---|---|---|---|---|---|---|
| | | | | | | | | | | | | | | Ta 0.012 |
| | 56 | 0.051 | 0.05 | 0.43 | 12.33 | 2.54 | 0.035 | 0.062 | N.A. | 0.006 | — | — | — | Zr 0.075, V 0.031 |
| | 57 | 0.059 | 0.29 | 0.39 | 13.19 | 1.88 | 0.018 | 0.027 | 0.017 | 0.003 | — | — | — | Nb 0.037, V 0.025, Ti 0.054 |
| | 58 | 0.038 | 0.32 | 0.97 | 11.98 | 2.99 | 0.032 | 0.043 | N.A. | N.A. | — | — | — | Ca 0.005 |
| | 59 | 0.025 | 0.29 | 1.54 | 12.85 | 3.02 | 0.043 | 0.026 | 0.015 | 0.007 | — | — | — | REM 0.008 |
| | 60 | 0.036 | 0.30 | 0.50 | 12.47 | 2.67 | 0.019 | 0.016 | 0.005 | 0.001 | — | — | — | Ti 0.037, Ca 0.004 |
| | 61 | 0.038 | 0.15 | 0.64 | 11.98 | 2.86 | 0.025 | 0.054 | N.A. | N.A. | — | — | — | Zr 0.053, Nb 0.042, Ca 0.005 |
| | 62 | 0.028 | 0.21 | 0.53 | 12.79 | 2.76 | 0.025 | 0.046 | 0.017 | 0.004 | 1.47 | — | — | Ti 0.026, V 0.037, Ca 0.003 |
| | 63 | 0.049 | 0.28 | 0.43 | 12.27 | 3.17 | 0.030 | 0.048 | 0.015 | 0.003 | 2.49 | 1.73 | — | Nb 0.048, V 0.052, Ca 0.005 |
| | 64 | 0.029 | 0.17 | 0.52 | 12.88 | 2.65 | 0.028 | 0.019 | 0.014 | 0.004 | 1.43 | 0.76 | 1.74 | Ti 0.085, Hr 0.015, Ta 0.025, REM 0.012 |
| | 65 | 0.088 | 0.39 | 0.40 | 13.43 | 3.93 | 0.042 | 0.011 | 0.017 | 0.004 | — | 1.33 | — | Ca 0.004 |
| | 66 | 0.052 | 0.28 | 0.37 | 12.46 | 2.55 | 0.027 | 0.028 | 0.011 | 0.004 | 2.03 | — | 0.59 | Ti 0.032, REM 0.008 |
| | 67 | 0.028 | 0.20 | 0.42 | 12.29 | 1.96 | 0.082 | 0.055 | 0.010 | 0.001 | — | 1.73 | 0.47 | Zr 0.019, Nb 0.039, Ca 0.006 |
| | 68 | 0.042 | 0.48 | 1.67 | 11.89 | 3.03 | 0.027 | 0.040 | N.A. | N.A. | 1.89 | 0.79 | — | V 0.053, Hr 0.088, Ca 0.005 |
| Comparative Alloy | 69 | 0.210 | 0.45 | 0.51 | 13.02 | — | 0.031 | 0.004 | 0.027 | 0.008 | 0.35 | — | — | |
| | 70 | 0.122 | 0.28 | 0.58 | 9.12 | — | 0.027 | 0.003 | 0.029 | 0.006 | — | 1.05 | — | |
| | 71 | 0.143 | 0.49 | 0.39 | 13.25 | 0.64 | 0.030 | 0.008 | 0.014 | 0.004 | 0.33 | — | — | |
| | 72 | 0.095 | 0.39 | 0.40 | 12.87 | — | 0.019 | 0.004 | 0.024 | 0.008 | — | 0.54 | 0.04 | |
| | 73 | 0.195 | 0.78 | 0.55 | 11.95 | 0.77 | 0.021 | 0.003 | 0.018 | 0.004 | 0.19 | — | — | Ca 0.005 |
| | 74 | 0.076 | 0.38 | 0.55 | 12.93 | — | 0.038 | 0.007 | 0.018 | 0.008 | 0.13 | — | — | REM 0.007 |

| | | Heat temperature | | Results of corrosion test*1 | | |
|---|---|---|---|---|---|---|
| | | Austenitizing temperature and cooling | Tempering temperature and cooling | Test temperature 150° C. | Test temperature 180° C. | Results of SSC test |
| Alloy of The Present Invention | 41 | 1030° C., air cooling | 720° C., air cooling | ◎ | ○ | ◎ |
| | 42 | 1050° C., oil cooling | 650° C., air cooling | ◎ | ◎ | ◎ |
| | 43 | 1050° C., air cooling | 660° C., air cooling | ◎ | ◎ | ◎ |
| | 44 | 1050° C., air cooling | 660° C., air cooling | ◎ | ◎ | ◎ |
| | 45 | 1030° C., air cooling | 700° C., air cooling | ◎ | ◎ | ◎ |
| | 46 | 1080° C., air cooling | 700° C., air cooling | ◎ | ◎ | ◎ |
| | 47 | 1080° C., air cooling | 660° C., air cooling | ◎ | ◎ | ◎ |
| | 48 | 1080° C., oil cooling | 710° C., air cooling | ◎ | ◎ | ◎ |
| | 49 | 1050° C., air cooling | 700° C., air cooling | ◎ | ◎ | ◎ |
| | 50 | 1050° C., air cooling | 710° C., air cooling | ◎ | ◎ | ◎ |
| | 51 | 1050° C., air cooling | 680° C., oil cooling | ◎ | ○ | ◎ |
| | 52 | 1050° C., air cooling | 680° C., air cooling | ◎ | ◎ | ◎ |
| | 53 | 1050° C., air cooling | 720° C., air cooling | ◎ | ○ | ◎ |
| | 54 | 1000° C., air cooling | 720° C., air cooling | ◎ | ◎ | ◎ |
| | 55 | 1030° C., air cooling | 700° C., air cooling | ◎ | ◎ | ◎ |
| | 56 | 1050° C., air cooling | 680° C., air cooling | ◎ | ○ | ◎ |
| | 57 | 1030° C., air cooling | 680° C., air cooling | ◎ | ○ | ◎ |
| | 58 | 1000° C., air cooling | 700° C., air cooling | ◎ | ◎ | ◎ |
| | 59 | 1000° C., water cooling | 720° C., air cooling | ◎ | ◎ | ◎ |
| | 60 | 1000° C., air cooling | 730° C., air cooling | ◎ | ◎ | ◎ |
| | 61 | 1050° C., air cooling | 650° C., air cooling | ◎ | ◎ | ◎ |
| | 62 | 1030° C., air cooling | 660° C., air cooling | ◎ | ◎ | ◎ |
| | 63 | 1030° C., air cooling | 710° C., air cooling | ◎ | ◎ | ◎ |
| | 64 | 1030° C., air cooling | 730° C., air cooling | ◎ | ◎ | ◎ |
| | 65 | 980° C., air cooling | 730° C., air cooling | ◎ | ◎ | ◎ |

TABLE 2-continued

| | | | | | | |
|---|---|---|---|---|---|---|
| | 66 | 1050° C., air cooling | 710° C., air cooling | ◎ | ◎ | ◎ |
| | 67 | 1050° C., water cooling | 700° C., air cooling | ◎ | ○ | ◎ |
| | 68 | 1000° C., air cooling | 710° C., air cooling | ◎ | ◎ | ◎ |
| Comparative Alloy | 69 | 1020° C., air cooling | 730° C., air cooling | × | ×× | × |
| | 70 | 980° C., air cooling | 700° C., air cooling | ×× | ×× | × |
| | 71 | 1020° C., air cooling | 710° C., air cooling | × | ×× | × |
| | 72 | 860° C., air cooling | 730° C., air cooling | ×× | ×× | × |
| | 73 | 1020° C., air cooling | 7000° C., air cooling | × | ×× | × |
| | 74 | 980° C., air cooling | 680° C., air cooling | ×× | ×× | × |

*[1]Corrosion test conditions: 3% NaCl aqueous solution, partial pressure of $CO_2$ 40 atm. 720 hours.
N.A.; not analyzed

What is claimed is:

1. Oil Country Tubular Goods (OCTG) or a line pipe formed of a high-strength martensitic stainless steel excellent in corrosion resistance and stress corrosion cracking resistance, the steel consisting essentially of: 0.1 wt % or less carbon, 1 wt % or less silicon, 2 wt % or less manganese, 8–14 wt % chromium, 1.2–4.5 wt % copper, 0.005–0.2 wt % aluminum, 0.01–0.15 wt % nitrogen and the balance being iron except for incidental elements, and the OCTG or the line pipe being obtained by a heat-treatment process comprising the following steps:

a) austenitizing the OCTG or the line pipe at 920° C. to 1,100° C. of temperature followed by cooling at a cooling rate equal to or higher than the air cooling rate, tempering the OCTG or the line pipe at a temperature between 580° C. and $Ac_1$ point followed by cooling at a cooling rate equal to or higher than the air cooling rate.

2. OCTG or a line pipe formed of the steel as claimed in claim 1 wherein the steel contains 0.025 wt % or less phosphorous and 0.015 wt % or less sulfur as incidental elements.

3. OCTG or a line pipe formed of the steel as claimed in claim 1 wherein the steel further contains at least one of 2 wt % of less molybdenum and 4 wt % or less tungsten.

4. OCTG or a line pipe formed of the steel as claimed in claim 1 wherein the steel further contains at least one element selected from the group consisting of 0.5% or less vanadium, 0.2% or less titanium and 0.5% or less niobium, 0.2% or less zirconium, 0.2% or less tantalum and 0.2% or less hafnium.

5. OCTG or a line pipe formed of the steel as claimed in claim 1 wherein the steel further contains at least one of 0.008% or less calcium and 0.02% or less rare earth elements.

6. OCTG or a line pipe formed of the steel as claimed in claim 1 wherein the steel contains 0.02% or less carbon.

7. OCTG or a line pipe formed of the steel as claimed in claim 2 wherein the steel further contains at least one of 2 wt % or less molybdenum and 4 wt % or less tungsten.

8. OCTG or a line pipe formed of the steel as claimed in claim 2 wherein the steel further contains at least one element selected from the group comprising 0.5% or less vanadium, 0.2% or less titanium and 0.5% or less niobium, 0.2% or less zirconium, 0.2% or less tantalum and 0.2% or less hafnium.

9. OCTG or a line pipe formed of the steel as claimed in claim 3 wherein the steel further contains at least one element selected from the group consisting of 0.5% or less vanadium, 0.2% or less titanium, and 0.5% or less niobium, 0.2% or less zirconium, 0.2% or less tantalum and 0.2% or less hafnium.

10. OCTG or a line pipe formed of the steel as claimed in claim 4 wherein the steel further contains at least one of 0.008% or less calcium and 0.02% or less rare earth elements.

11. OCTG or a line pipe formed of the steel as claimed in claim 2 wherein the steel contains 0.02% or less carbon.

12. OCTG or a line pipe formed of the steel as claimed in claim 3 wherein the steel contains 0.02% or less carbon.

13. OCTG or a line pipe formed of the steel as claimed in claim 4 wherein the steel contains 0.02% or less carbon.

14. OCTG or a line pipe formed of the steel as claimed in claim 5 wherein the steel contains 0.02% or less carbon.

* * * * *